US005300936A

United States Patent [19]

Izadian

[11] Patent Number: 5,300,936

[45] Date of Patent: Apr. 5, 1994

[54] MULTIPLE BAND ANTENNA

[75] Inventor: Jamaledin Izadian, San Jose, Calif.

[73] Assignee: Loral Aerospace Corp., New York, N.Y.

[21] Appl. No.: 954,274

[22] Filed: Sep. 30, 1992

[51] Int. Cl.[5] ..... H01Q 1/38; H01Q 21/28

[52] U.S. Cl. ..... 343/700 MS; 343/727; 343/728; 343/741

[58] Field of Search ..... 343/700 MS File, 725, 343/726, 728, 741, 900, 901, 853, 893; H01Q 1/38, 5/00, 5/01, 1/32, 21/24, 21/26, 21/28, 21/30

[56] References Cited

U.S. PATENT DOCUMENTS

| | | | |
|---|---|---|---|
| 3,721,990 | 3/1973 | Gibson et al. | 343/726 |
| 3,852,747 | 12/1974 | Kaiser | 343/713 |
| 4,030,100 | 6/1977 | Perrotti | 343/709 |
| 4,329,689 | 5/1982 | Yee | 343/700 MS |
| 4,644,361 | 2/1987 | Yokoyama | 343/700 MS |
| 4,675,687 | 6/1987 | Elliott | 343/903 |
| 4,755,823 | 7/1988 | Ohe et al. | 343/713 |
| 4,821,040 | 4/1989 | Johnson et al. | 343/700 MS |
| 4,835,541 | 5/1989 | Johnson et al. | 343/713 |
| 4,887,089 | 12/1989 | Shibata et al. | 343/700 MS |
| 4,943,809 | 7/1990 | Zaghloul | 343/700 MS |
| 5,099,249 | 3/1992 | Seavey | 343/700 MS |

*Primary Examiner*—Michael C. Wimer
*Attorney, Agent, or Firm*—Perman & Green

[57] ABSTRACT

An antenna for reception of signals in a plurality of frequency bands employed in portable and vehicular communications is constructed of a dielectric layer disposed on a metallic plate which serves as a ground plane. Microstrip antenna elements in the form of a planar radiator encircled by a loop radiator are disposed upon the dielectric layer. A rod radiator oriented normally to the plate extends through the patch radiator and the dielectric layer, and is surrounded by a dielectric cylinder which insulates the rod radiator from the planar radiator and the plate. The planar radiator may be configured as a patch radiator, a spiral radiator, or a crossed dipole radiator. Also, one or more additional layers of patch radiator elements may stacked upon the patch radiator to provide a stacked microstrip radiator. Terminals are positioned about the planar radiator for extracting orthogonal components of a circularly polarized electromagnetic signal. All radiators are smaller than approximately one-half wavelength of the shortest wavelength signal to be received by the antenna. The antenna is useful for receiving vehicular signals such as telephony, keyless door lock operation, ground positioning satellite signals, as well as AM/FM radio.

18 Claims, 4 Drawing Sheets

MULTIPLE BAND ANTENNA

BACKGROUND OF THE INVENTION

This invention relates to portable antennas such as a vehicular antenna and, more particularly, to a unitary antenna structure having separate portions configured for reception of signals in different frequency bands.

Vehicular antenna systems, such as those mounted on automotive vehicles including cars and trucks, may be employed to provide a radio link for various electronic systems providing a number of functions, such as the keyless entry to the vehicle for remotely locking and unlocking the vehicle as well as turning lights and possibly the engine on and off. Additional functions include alarm activation and deactivation, cellular telephony, and radio including both AM and FM radio. Yet another function which may be employed is reception of signals received from a global positioning satellite (GPS) for navigating an automobile and for trip planning.

All of these functions are implemented with the aid of some type of a radio link requiring a transmitter and/or a receiver installed within the vehicle. The radio link for the various functions is accomplished by use of separate frequency bands designated for the individual functions. The frequency bands for these functions are as follows. The global positioning satellite operates in a frequency band of 1.2–1.6 GHz (gigahertz) with a nominal wavelength of 8.5 inches, the transmission of the GPS signal being in the nature of a spread spectrum modulation. The cellular telephony operates at a frequency of approximately 860 MHz (megahertz) and has a nominal wavelength of 14 inches. In the future, there may be microwave operation at L-Band and S-Band for satellite based cellular telephone. The AM radio operates in a frequency band 540–1600 KHz (kilohertz) and has a nominal wavelength of 1100 inches. The FM radio operates in a frequency band of 88–108 MHz, and has a nominal wavelength of 120 inches. The keyless vehicle entry operates at a nominal frequency of 315 MHz and has a nominal wavelength of 37.5 inches. It is anticipated that other functions facilitating the use and safety of motor vehicles will also become available, and that such functions will be allocated a specific band of the electromagnetic spectrum for communication with the vehicle. Presently, separate antennas are provided for accomplishing some of these functions. Some functions, such as the AM radio and the FM radio may be combined to operate with a single telescoping pole, or mast, operative as a monopole antenna.

A problem arises in that, heretofore, a vehicle, such as an automobile, must carry a variety of antennas to provide the benefits of the aforementioned functions. This is inconvenient from a point of view of manufacture and installation, as well as aesthetic appearance, and maintenance or repair of breakage or vandalism.

SUMMARY OF THE INVENTION

The aforementioned problem is overcome and other advantages are provided by an antenna system of the invention which is constructed as a unitary antenna assembly having separate portions, or components, which are operative in respective ones of the foregoing frequency bands designated for providing the functions of keyless entry, GPS, AM-FM radio, and cellular telephony. It is noted that the foregoing set of designated frequency bands is based on the present construction of such vehicular systems, and that other frequency bands may be employed for portable systems with their antennas, and various vehicular functions in the future.

In accordance with the invention, the unitary antenna structure includes a telescoping pole, or rod, operative as a monopole radiator, for reception of AM - FM radio signals, and for reception of cellular telephony. A microstrip patch antenna is provided for the GPS at a base of the telescoping pole. The pole is positioned directly in a metallic surface, of the vehicle, the metallic surface serving as a ground plane for radiation patterns produced by the components of the unitary antenna structure. Also included within the unitary antenna structure is a loop antenna which encircles the patch antenna, and is employed for the keyless-entry function. The pole antenna has a length less than approximately one-half wavelength of the FM signal. The patch antenna for the GPS has a size measuring approximately four inches, this being equal approximately to half wavelength of the GPS signal, the patch antenna being designed to radiate at a desired resonant mode. The loop antenna has a circumference only slightly larger than that of the microstrip patch antenna and, accordingly, has a cross-sectional dimension significantly smaller than one-quarter wavelength of the keyless-entry signal. The loop antenna is designed to radiate at a desired resonant mode for its geometry.

Each portion of the unitary antenna structure provides a desired shape of radiation pattern. The GPS microstrip patch antenna is designed to provide a generally hemispherical form of radiation pattern. The radiation pattern of telescoping pole is omnidirectional in a horizontal plane perpendicular to the pole. The loop antenna provides a radiation pattern having the form of a torus distributed symmetrically about an axis of the group antenna. The foregoing radiation patterns are understood to be measured at the far field, a distance of many wavelengths, from the antenna structure. However, since the components of the antenna structure may be on the order of a wavelength of some of the radiations, it is apparent that any electromagnetic interaction among components of the antenna system occur in the near field of various radiation patterns associated with each of the antenna components. Because of the near field coupling, and/or interaction, among the relatively small-closely-spaced-antenna components, inductance and capacitance between the various antenna components constitute factors determining the mutual impedance and loading of each antenna component upon an external circuit which either drives a component of the antenna or receives signals from a component of the antenna. In accordance with a feature of the invention, the configuration and the arrangement of the antenna components permit the antenna components to receive their designated signals, essentially without significant interference from other ones of the signals, so that all of the foregoing functions can be performed adequately.

BRIEF DESCRIPTION OF THE DRAWING

The aforementioned aspects and other features of the invention are explained in the following description, taken in connection with the accompanying drawing wherein.

DETAILED DESCRIPTION

Figure 1:
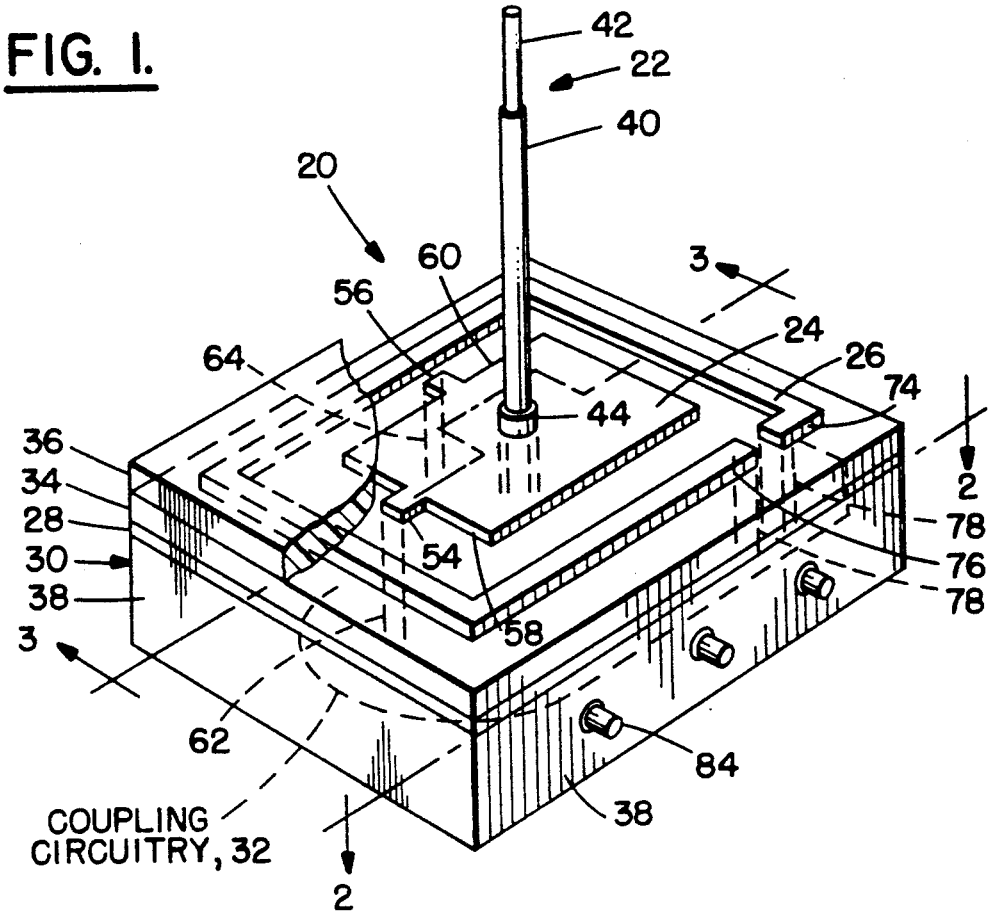
FIG. 1 is a perspective view, partially diagrammatic, of a antenna assembly incorporating the invention, a portion of a cover layer being partially cut away to expose components of the antenna assembly.
Figure 2:
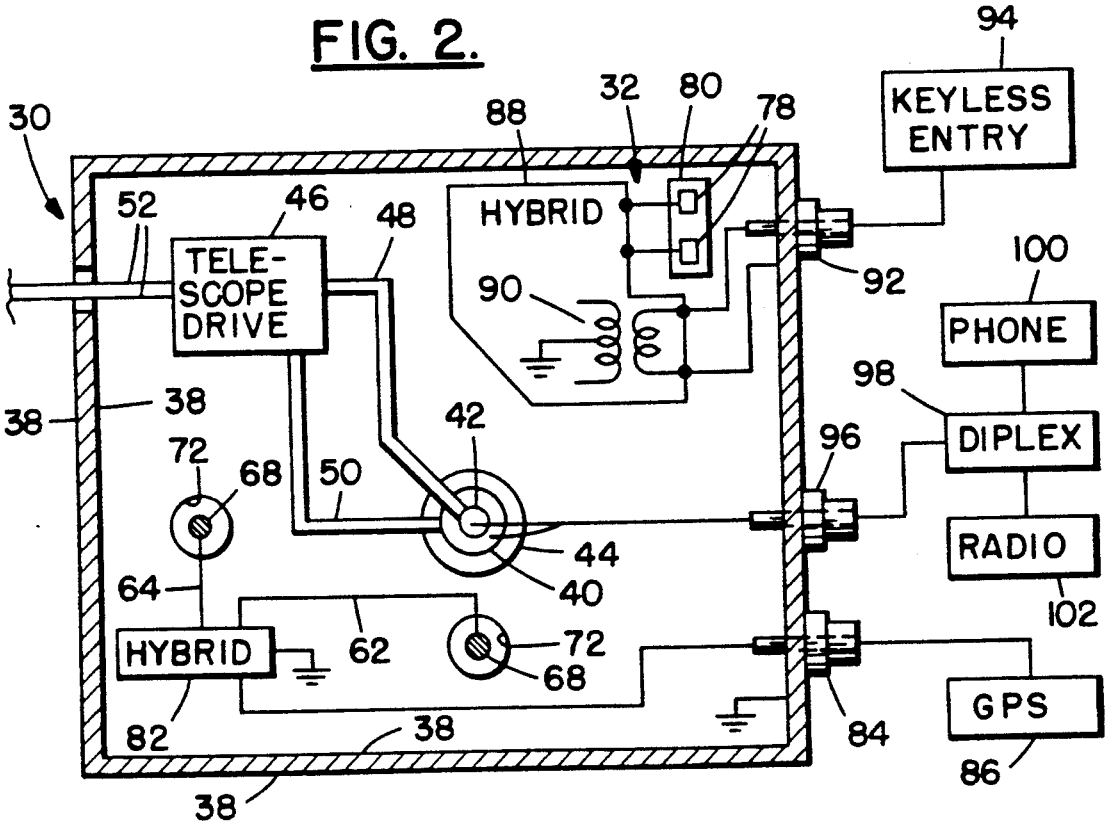
FIG. 2 is a plan view, partially diagrammatic, of the antenna assembly taken along the line 2—2 in FIG. 1, the view of FIG. 2 also showing external electronic equipment connected to the antenna assembly, the line 2—2 extending along a bottom surface of a ground plate of the antenna assembly.
Figure 3:
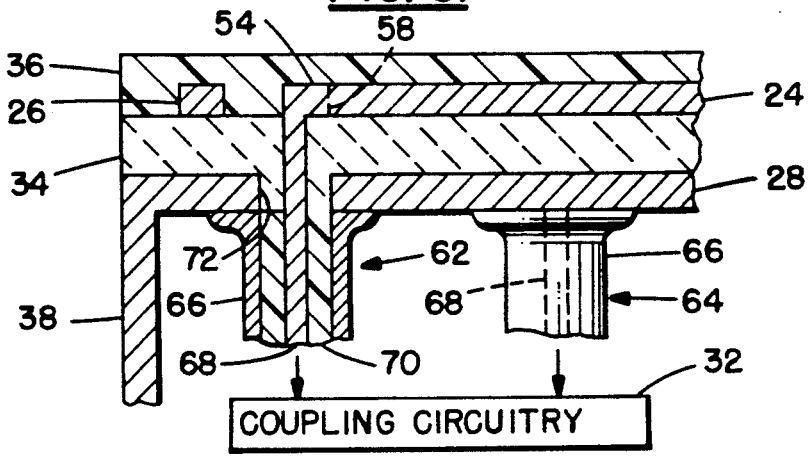
FIG. 3 is a fragmentary portion of a sectional view taken along the line 3—3 in FIG. 1, FIG. 3 showing diagrammatically also a connection to electronic circuitry.

FIGS. 1-3 show an antenna assembly 20 comprising a telescoping rod shaped radiator 22, a planar radiator 24 in the shape of a patch disposed about a base of the rod radiator 22, and a loop radiator 26 encircling both the planar radiator 24 and the rod radiator 22. The rod radiator 22, the planar radiator 24, and the loop radiator 26 are supported upon a metallic, electrically-conducting plate 28 which serves as a ground plane of the antenna assembly 20, and also forms the top of a metallic box 30 which serves as a base of the antenna assembly 20. The box 30 encloses coupling circuitry 32 by which external electronic components are coupled to the planar radiator 24 and the loop radiator 26, and to the body of the vehicle 30 as extended ground plane.

The planar radiator 24 is supported by a dielectric layer 34 which rests upon the plate 28 and serves as a spacer for providing a desired spacing between the planar radiator 24 and the plate 28. The dielectric layer 34 extends outward beyond the planar radiator 24 to support the loop radiator 26 and to serve as a spacer between the loop radiator 26 and the plate 28. This form of construction is recognized as the microstrip form of construction and, accordingly, both the planar radiator 24 and the loop radiator 26 are microstrip radiating components. If desired, a protective cover layer of an electrically insulating material may be provided on top of the planar radiator 24, the radiator 26 and exposed portions of the top surface of the plate 28. The planar radiator 24 and the loop radiator 26 are fabricated of electrically conductive material, preferably a metal such as copper or aluminum which can be deposited on the dielectric layer and configured with a desired shape by photolithography and well-known etching procedures. Similarly, the box 30 including both the plate 28 and sidewalls 38 of the box 30 are fabricated of a metal such as copper or aluminum. The dielectric layer 34 may be fabricated of a ceramic, electrically-insulating material such as alumina.

The rod radiator 22 is fabricated of a plurality of elongated cylindrical elements of which two such elements 40 and 42 are shown by way of example, the element 42 telescoping within the element 40. By way of example in the construction of an alternative embodiment of the rod radiator, as will be described with reference to FIG. 14, the rod radiator may be fabricated with a choke to vary its electrical length, in terms of the number of wavelengths or fractional wavelength of received radiation, to accommodate various frequencies. The rod radiator 22 is surrounded by a dielectric, electrically-insulating cuff 44 which encircles the base of the rod radiator 22 for positioning the rod radiator 22 upon the plate 28. The cuff 44 allows the rod radiator 22 to pass through the planar radiator 24, the dielectric layer 34, and the plate 28 while maintaining electrical insulation between the rod radiator 22 and the planar radiator 24 as well as between the rod radiator 22 and the plate 28. A telescope drive 46 is mounted on a bottom side of the plate 28, and is connected by mechanical links 48 and 50, indicated diagrammatically in FIG. 2, to the elements 40 and 42, respectively, of the rod radiator 22 for elevating the radiator 22 to a desired height, and for retracting the radiator 22 via a telescoping of the radiator 22. Electric signals for activating the drive 46 are provided by an external source (such as a radio, telephone and/or ignition circuit, not shown) by wires 52.

The planar radiator 24 is provided with two terminals 54 and 56 which extend, respectively from sides 58 and 60 of the planar radiator 24, the two sides 58 and 60 being perpendicular. The terminal 54 is located at the center of the side 58, and the terminal 56 is located at the center of the side 60. This arrangement of the terminals 54 and 56 allows for a space-quadrature energization of the planar radiator 24 to produce a circularly polarized electromagnetic wave upon introduction of a phase shift of 90 degrees between signals applied to the terminals 54 and 56. Similarly, during reception of electromagnetic radiation by the planar radiator 24, the radiator 24 can receive circularly polarized radiation with orthogonal components of the radiation appearing at the terminals 54 and 56. The terminals 54 and 56 connect with the coupling circuitry 32 by means of coaxial transmission lines 62 and 64, respectively. Each of the transmission lines 62 and 64 comprises an outer electrically-conductive metallic shell 66 and an inner central conductor 68 which are spaced apart by a dielectric, electrically-insulating cylinder 70. In the transmission line 62, the central conductor 68 connects with the terminal 54. In the transmission line 64, the central conductor 68 connects with the terminal 56. The central conductor 68, for each of the transmission lines 62 and 64, passes through an aperture 72 in the plate 28 to make connection with the respective one of the terminals 54 and 56, the apertures 72 having the same diameters as the inner diameter of the shells 66. In similar fashion, the loop radiator 26 is cut to form two loop terminals 74 and 76 which connect via electrically-conductive rod elements 78, or insulated plated through holes (not shown), to the coupling circuitry 32. The rod elements 78 pass via an aperture 80 (FIG. 2) in the plate 28.

The coupling circuitry 32 includes a hybrid circuit 82 for receipt of signals of a global positioning satellite (GPS), the hybrid circuit 82 combining the signals received by the transmission lines 62 and 64 into a single signal which is outputted via a coaxial connector 84 to electrical circuitry operative with a GPS system 86, the connector 84 being mounted in a sidewall 38 of the box 30. The hybrid circuit 82 provides for a phase shift of 90 degrees between components of the circularly polarized signals communicated via the transmission lines 62 and 64 from the planar radiator 24 so as to combine the two components into a single output signal which is applied to the GPS system 86. The hybrid circuit 82 is constructed in a well-known fashion, and may be realized as a microstrip circuit. The hybrid circuit 82 is positioned at a location of convenience, such as by being mounted to a bottom surface of the plate 28, as indicated in FIG. 2, or by being placed directly on the top surface (not shown) of the dielectric layer 34 and connected to the terminals 54 and 56 by microstrip feed lines (not shown).

The coupling circuitry 32 comprises a further hybrid circuit 88 connecting via the rod elements 78 to the loop radiator 26. The hybrid circuit 88 includes a balun 90 for coupling signals via a coaxial connector 92 to circuitry of a keyless entry system 94. The coaxial connector 92 is mounted in a sidewall 38 of the box 30. An electromagnetic signal received by the loop radiator 26 induces a phase shift of 90 degrees between the terminals 72 and 76 of the loop radiator 26 and, accordingly, the hybrid circuit 88 introduces a further phase of 90 degrees between these two signals so as to combine the two signals at the balun 90 for outputting to the keyless entry system 94. The hybrid circuit 88 is fabricated of well-known circuitry, and is positioned at a location of convenience, such as by a mounting on the bottom surface of the plate 28, as is indicated in FIG. 2. It is to be understood that, with respect to both of the hybrid circuits 82 ad 88, the presentation of the circuits in FIG. 2 is diagrammatic and has been simplified by omitting well-known components such as terminating resistors for unused ports of the hybrid circuits.

The coupling circuit 32 also provides for connection of the element 42 of the rod radiator 22 via a coaxial connector 96 (FIG. 2) and a diplexer 98 for communication of signals to a telephone 100 and a radio 102. The center conductor of the connector 96 is connected to the antenna elements 40 and 42. The diplexer 98 is operative to separate signals in different frequency bands, thereby to apply telephone signals to the telephone 100 and radio signals to the radio 102. The diplexer 98 operates in reciprocal fashion so as to communicate outgoing telephony signals from the telephone 100 to the rod radiator 22 for transmission therefrom. The ground plane of the plate 28 cooperates with the rod radiator 22 in developing its monopole radiation pattern, the ground plane being connected via the box 30 to the outer conductor of the connector 96 by virtue of a mounting of the connector 96 to a sidewall 38 of the box 30.

Figure 4:
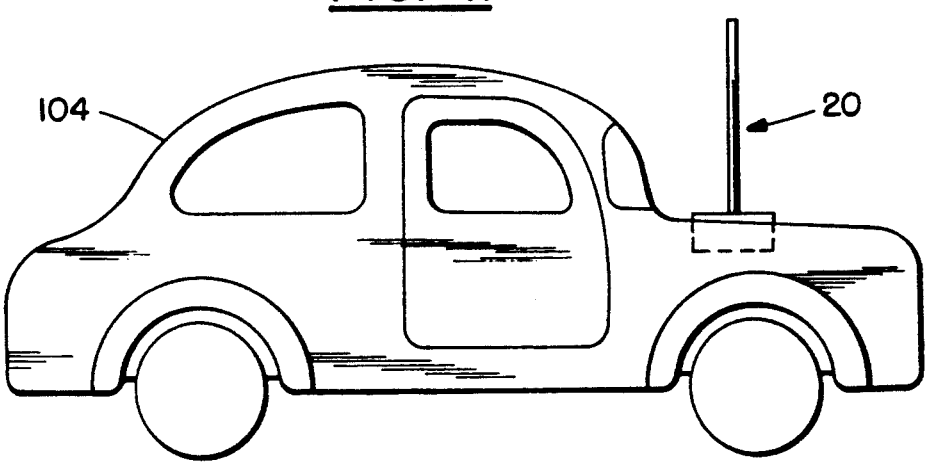
FIG. 4 is a stylized view of a motor vehicle with the antenna assembly of FIG. 1 mounted to an exterior surface of the vehicle.
Figure 5:
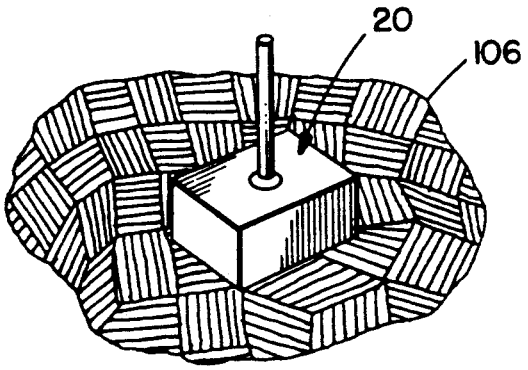
FIG. 5 shows deployment of the antenna assembly of FIG. 1, in stylized fashion, upon the surface of the earth.

The antenna assembly 20 is portable, as is shown in FIGS. 4 and 5. In FIG. 4, the antenna assembly 20 is mounted in a depression in the fender of an automobile 104. The circuits of the keyless entry system 94, the GPS system 86, the telephone 100 and the radio 102 (shown in FIG. 2 but not in FIG. 4) are carried within the vehicle 104 and connected to the antenna assembly 20 as disclosed in FIG. 2. The automobile 104 is understood to be fabricated of metal, particularly the outer surface thereof being formed as a metallic surface. The metallic surface of the automobile 104 serves as a continuation of the ground plane of the plate 28 of the antenna assembly 20. In FIG. 5, the antenna assembly 20 is mounted directly on the earth's surface, on the ground 106 which, by virtue of its electrical conductivity, serves as an extension of the ground plane provided by the plate 28 of the antenna assembly 20. By way of example in the use of the antenna assembly 20 of FIG. 5, the GPS system 86 (not shown in FIG. 5) may be connected to the antenna assembly 20 so as to allow a hiker to determine his location in the forest. Also, if desired, the telephone 100 may be connected to the antenna system 20 to enable the hiker to communicate with people at distant locations. In the situation of FIG. 5, the antenna assembly 20 with its associated circuitry would be operated by battery electric power (not shown).

Figure 6:
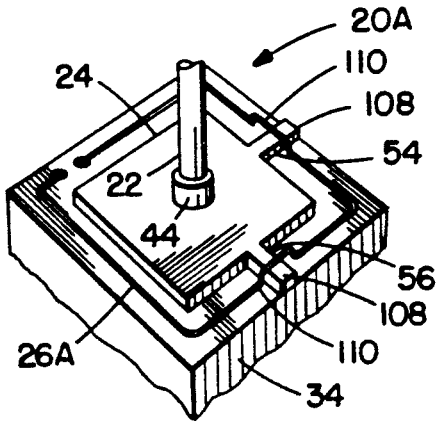
FIG. 6 shows an alternative form of construction of the antenna assembly wherein portions of a loop component of the antenna assembly jump over feeds for a patch radiator of the assembly.

FIG. 6 shows a fragmentary view of a antenna assembly 20A which is an alternative embodiment to the antenna assembly 20 of FIG. 1. In FIG. 6, the planar radiator 24 is provided with microstrip feeds 108 connected to the terminals 54 and 56 for coupling signals between the planar patch radiator 24 and a hybrid circuit (not shown) such as the hybrid circuit 82 (FIG. 2), the hybrid circuit being positioned at a location of convenience either on top of the dielectric layer 34, or below the plate 28. The antenna assembly 20A includes a loop radiator 26A provided with wire sections 110 which jump over the feeds 108. In other respects, the loop radiator 26A is similar in both shape and function to that of the loop radiator 26 of FIG. 1.

Figure 7:
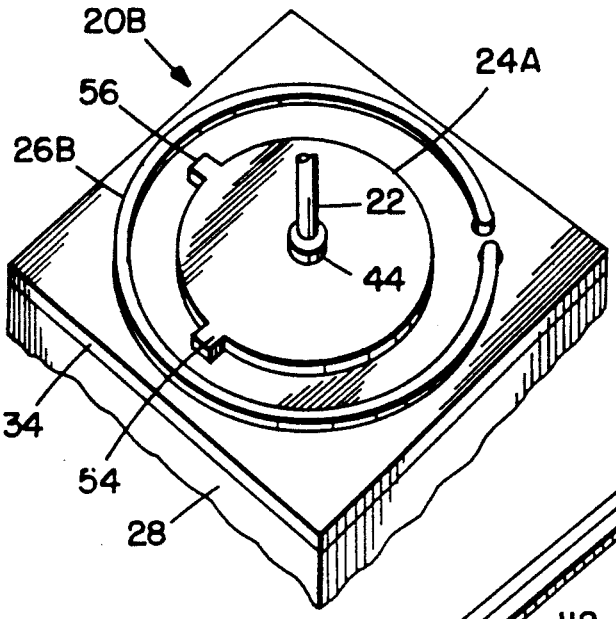
FIGS. 7, 8 and 9 show simplified fragmentary perspective views of alternative embodiments of the antenna assembly providing respectively for a circular patch and loop radiators, orthogonally disposed dipole radiators encircled by a rectangular loop and a dipole spiral configuration of radiator.

FIG. 7 shows a fragmentary view of an antenna assembly 20B which is an alternative embodiment to the assembly of FIG. 1. In FIG. 7, the assembly 20B includes the planar radiator 24A configured as a circular patch and having the terminals 54 and 56, previously described, for coupling of signals from the planar radiator 24A. The planar radiator 24A is encircled by a loop radiator 26B of circular configuration, in contrast to the square configuration of the loop radiator of FIG. 1. The planar radiator 24 and a loop radiator 26B are supported by the dielectric layer 34 which, in turn, rests upon the plate 28 in the same manner as has been described above with reference to the antenna assembly of FIG. 1. Included in the assembly 20B of FIG. 7 is the rod radiator 22 which functions in the same manner as described above with reference to FIG. 1. In the operation of the planar radiator 24A, circular polarization is produced and, with respect to the loop radiator 26B, the radiation pattern is essentially the same as that produced by the loop radiator 26 of FIG. 1.

Figure 8:
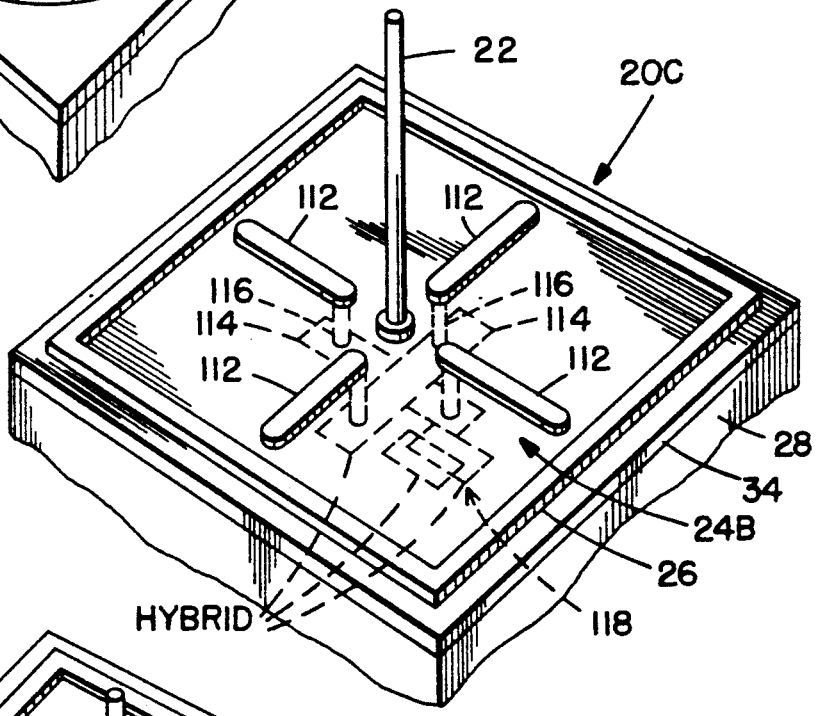

FIG. 8 shows an antenna assembly 20C which is an alternative embodiment to the assembly of FIG. 1. In FIG. 8, the antenna assembly 20C comprises a planar radiator 24B comprising an array of four longitudinal radiating elements 112 forming two orthogonally positioned pairs of dipole radiators enclosed by the loop radiator 26. The radiating elements 112 and the loop radiator 26 are supported by the dielectric layer 34 which, in turn, rests upon the plate 28. The rod radiator 22 is located along a central axis of the antenna assembly 20C. The radiating elements 112 in each pair are colinear. The antenna assembly 20C further comprises two hybrid circuits 114, indicated in phantom view, which function in a manner similar to that of the hybrid circuit 82 (FIG. 2) for providing output signals in response to illumination of the dipoles of the paired elements 112 during reception of an electromagnetic signal. The inboard ends of the radiating elements 112, facing the rod radiator 22, connect via conductors 116 to terminals of the hybrid circuits 114. The conductors 116 are parallel to the rod radiator 22. The conductors 116 pass through the dielectric layer 34 and the plate 28 in the same manner as do the conductors 68 of FIG. 2. The hybrid circuits 114 are secured to the bottom surface of the plate 28 in the same fashion as has been described above for the hybrid circuit 82 in FIG. 2. The hybrid circuits 114 serve the function of combining the signals of the paired radiating elements 112, and for introducing a phase shift of 180 degrees to accomplish the combining of the two signals. Output signals of the two hybrid circuits 114 are, in turn, combined by a third hybrid circuit 118 which introduces a ninety degree phase shift between signals of the two hybrid circuits 114 to receive circularly polarized signals. Thus, the operation of the antenna assembly 20C of FIG. 8 is in accord with that of the antenna assembly 14 of FIG. 1.

Figure 9:
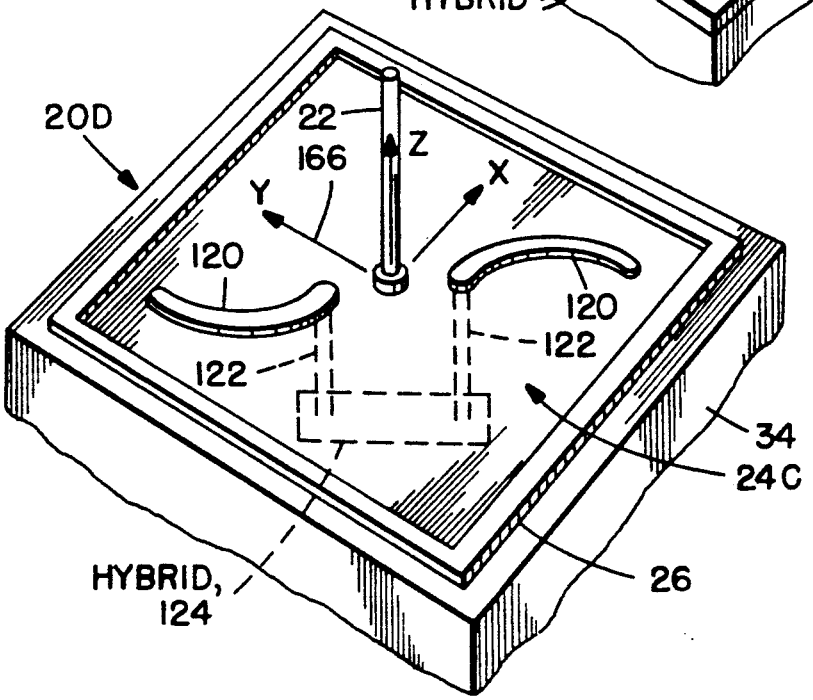

FIG. 9 shows an antenna assembly 20D which is an alternative embodiment of the assembly of FIG. 1. In FIG. 9, the assembly 20D includes a planar radiator 24C comprising two spiral arms 120 spaced apart from and positioned symmetrically about the rod radiator 22. The spiral arms 120 are surrounded by the loop radiator 26. The spiral arms 120 and the loop radiator 26 are disposed upon the dielectric layer 34. Inboard ends of the spiral arms 120, facing the rod radiator 22, are connected by conductors 122, shown in phantom view, to a hybrid circuit 124. The conductors 122 are oriented parallel to the rod radiator 22, and pass through the dielectric layer 34 and the plate 28 (not shown in FIG. 9) in the same fashion as disclosed for the conductors 68 of FIG. 1. The hybrid circuit 124 is positioned at a location of convenience, such as by being mounted to the bottom surface of the plate 28. The hybrid circuit 124 is operative to combine electromagnetic signals received by each of the arms 120 to provide a single output signal, as does the hybrid circuit 82 of FIG. 2. In addition, the hybrid circuit 124 introduces a phase shift of 180 degrees between the arms 120 so as to accomplish the combining of the signals received by the two arms 120. As is well known, an operating charaoteristic of a pair of spiral radiating elements, such as the two arms 120, is the capacity to receive circularly polarized radiation, and the capacity to generate circularly polarized radiation upon a transmitting of an electromagnetic signal. Thus, the antenna assembly 20D of FIG. 9 is capable of operating with the same radiation patterns and polarization as does the assembly 20 of FIG. 1.

Figure 10:
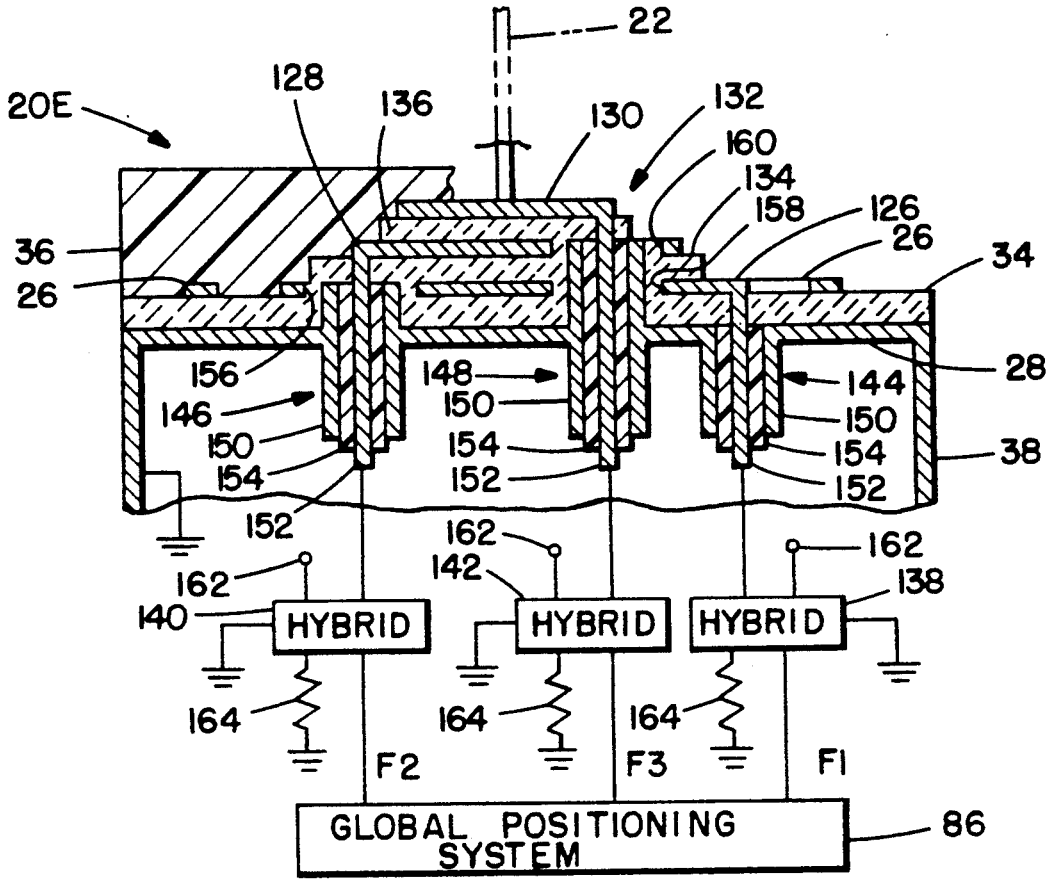
FIG. 10 is a sectional view, similar to that of FIG. 3, for a further embodiment of the invention employing a stack of three patch radiators for multiple frequency band use, FIG. 10 also showing diagrammatically a coupling of the patch radiators to electronic circuitry.

FIG. 10 shows an antenna assembly 20E which is a further embodiment of the assembly of FIG. 1. The assembly 20E of FIG. 10 differs from that of FIG. 1 in that the assembly 20E comprises a stack of three patch radiators 126, 128, and 130 which are stacked one upon the other instead of the single planar radiator 24 of FIG. 1. The assembly 20E of FIG. 10 includes the loop radiator 26 and the rod radiator 22 which are constructed and function in the same fashion as has been described with reference to the assembly 20 of FIG. 1. The assembly 20E of FIG. 10 also includes the cover layer 36, the cover layer 36 being partially cutaway to facilitate a showing of the components of the assembly 20E. The stack of the patch radiators 126, 128, and 130 are configured as a pyramid 132 with the largest of the patch radiators 126 being at the bottom of the pyramid 132. The smallest of the patch radiators 130 is at the top of the pyramid 132, the remaining patch radiator 128 being of intermediate size and being disposed between the radiators 126 and 130. Each of the radiators 126, 128 and 130 has a planar form, and is disposed parallel to the plate 28.

The dielectric layer 34 serves as a spacer between the bottom radiator 126 and the plate 28. A second dielectric layer 134 serves as a spacer between the radiators 126 and 128. A third dielectric layer 136 serves as a spacer between the radiators 128 and 130. Three hybrid circuits 13S, 140, and 142 connect the patch radiators of the pyramid 132 to the GPS system 86.

The stack of path radiators of FIG. 10 provides for a greater bandwidth than the single planar radiator 24 of FIG. 1. The spiral arm configuration of FIG. 9 also provides for a greater bandwidth than does the single planar patch radiator 24 of FIG. 1. In FIG. 10, the hybrid circuit 138 connects via a coaxial. transmission line 144 to the bottom and largest patch radiator 126 for reception of electromagnetic signals at a lower frequency band F1. The hybrid circuit 140 connects via a coaxial transmission line 146 to the middle patch radiator 128 for reception of electromagnetic signals at a middle frequency band F2. The hybrid circuit 142 connects the top and smallest patch radiator 130 via a coaxial transmission line 148 for reception of electromagnetic signals at a higher frequency band F3.

The three coaxial transmission lines 144, 146, and 148 are constructed in the same general fashion as has been disclosed for the transmission lines 62 and 64 of FIG. 3. Thus, in FIG. 10, all of the transmission lines 144, 146, and 148 comprises an outer shell 150, a central conductor 152, and a dielectric cylindrical spacer 154 which centers the conductor 152 within the shell 150 and insulates the conductor 152 from the shell 150. Each of the shells connects with the plate 28. In the transmission lines 144, 146, and 148, respectively, the central conductors 152 extend from the patch radiators 126, 128, and 130, respectively, to the hybrid circuits 138, 140, and 142, respectively. In the transmission line 146, the shell 150 extends up to the second dielectric layer 134, and is insulated from the radiator 126 by virtue of an aperture 156 in the radiator 126. In the transmission line 148, the shell 150 extends up to the third dielectric layer 132, and is insulated from the radiators 126 and 128 by virtue of apertures 158 and 160 respectively, within the radiators 126 and 128.

As has been disclosed in the embodiment of the antenna assembly of FIGS. 1-3, the planar patch radiator 24 has two terminals 54 and 56 which connect with two input terminals of the hybrid circuit 82 for reception of an electromagnetic signal. In similar fashion, in FIG. 10, each of the patch radiators 126, 128, and 130 are provided with two terminals for connection with the hybrid circuits 138, 140, and 142, respectively. To facilitate the presentation of the antenna assembly 20E, in FIG. 10, only one terminal of respective ones of the patch radiators 126, 128, and 130 are shown connected via their respective transmission lines 144, 146, and 148 to their respective hybrid circuits 138, 140, and 142. It is to be understood that a further set of three transmission lines, (not shown) connects the second terminal (not shown) in each of the patch radiators 126, 128, and 130 to the remaining terminals 162 in each of the hybrid circuits 138, 140, and 142. A fourth terminal in each of the hybrid circuits 138, 140, and 142 is shown terminated by a resistor 164.

In operation, each of the hybrid couplers 138, 140, and 142 is operative, during reception of circularly polarized electromagnetic signals, to combine the two orthogonal components of a received electromagnetic signal into a single output signal, respectively, for the patch radiators 126, 128, and 130. Thus, the patch radiators of the pyramid 132 are operative to receive circularly polarized signals for operation of the GPS system 86. The loop radiator 26 and the rod radiator 22 operate as has been described above with reference to FIGS. 1–3. Therefore, the antenna assembly 20E of FIG. 10 is operative with radiation patterns and polarizations in a manner similar to that described above with reference to the antenna assembly 20 of FIGS. 1–3. The patch radiators 126, 128, and 130 may have a square shape, or a circular shape, or may be elongated in one direction such as in the case of a rectangular or elliptical shape should it be desired to alter the radiation pattern in one direction from that of the perpendicular direction.

Figure 11:
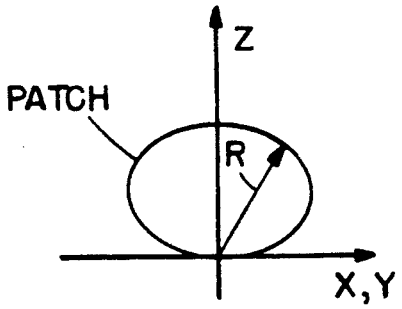
FIG. 11 shows a radiation pattern for a patch radiator of an antenna assembly of FIG. 1.
Figure 12:
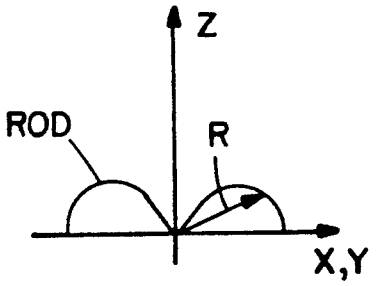
FIG. 12 shows a radiation pattern for a rod radiator of a patch antenna assembly of FIG. 1.
Figure 13:
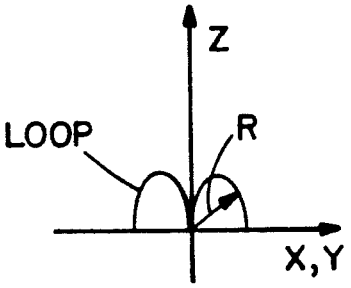
FIG. 13 shows a radiation pattern for a loop radiator of an antenna assembly of FIG. 1.

FIGS. 11, 12 and 13 show radiation patterns for the three components of the antenna assembly 20 of FIG. 1, these figures being applicable also to the alternative embodiments of the antenna assembly disclosed in FIGS. 6–10. An XYZ coordinate axes system is shown at 166 in FIG. 9, these coordinate axes being applicable also to the other embodiments of the antenna system. In each of FIGS. 11, 12, and 13, there is a graph presenting the intensity of the radiation patterns as a function of the coordinate axes X, Y, and Z. The intensity is represented by the length of a radius vector R in each graph. FIG. 11 shows the radiation pattern provided by the planar patch radiator 24 of FIG. 1, and the corresponding embodiments thereof in FIGS. 6–10 for operation of the GPS system 86. FIG. 12 shows the radiation pattern produced by the rod radiator 22 for operation of the telephone and the radio. FIG. 13 shows the radiation pattern of the loop radiator for operation of the keyless entry system.

Figure 14:
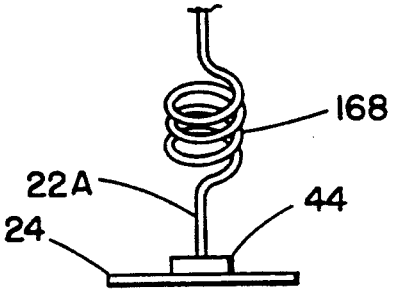
FIG. 14 is a fragmentary view of an alternative embodiment of the antenna assembly of FIG. 1 wherein a rod radiator incorporates a coil section.

FIG. 14 shows an alternative embodiment of the antenna assembly of FIG. 1 wherein, instead of the rod radiator 22, there is provided a rod radiator 22A which incorporates a choke or coil section 168. The coil section 168 loads the rod radiator 22A electrically so as to allow a shortening of its physical length, and also enhances reception of an electromagnetic signal in the event that the rod radiator 22A is inclined at an angle to the vertical. While the rod radiator 22A has been described with reference to the construction of the antenna assembly 20 of FIG. 1, it is to be understood that the rod radiator 22A may be incorporated into other ones of the antenna assembly of FIGS. 6–10.

With respect to the physical sizes of the radiators of the antenna assembly 20, and of the various embodiments thereof, the rod radiator has an overall length which is greater than a cross-sectional dimension of the loop radiator, but is less than or equal to approximately one-half wavelength of the electromagnetic signal for the cellular telephony, and a much smaller fraction of a wavelength of the radio frequencies of both AM and FM reception. The size and the length of an antenna are important design parameters since an antenna is designed to radiate at a given desired mode for which a specific size and dimension is selected. Therefor, this embodiment could have various sizes to accomplish the same end result. In the case of the loop radiator for reception of signals for the keyless entry system, a diameter of the loop is in the range of 4–6 percent of a wavelength of the electromagnetic signal. The planar radiator, whether in the shape of the patch radiator of FIGS. 1–3, or the alternative embodiments of FIGS. 6–9, has a length on a side of approximately one-half wavelength of the electromagnetic signal for the global positioning satellite. In the case of the antenna assembly of FIG. 10, each of the patch radiators of the pyramid 132 has a length on a side of approximately one-half wavelength for the specific frequency band of the electromagnetic signal being received for the ground positioning system.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A multiple band antenna comprising:

an electrically conductive plate serving as a ground plane;

a first planar electrically conductive radiator disposed parallel to said ground plane, and a first dielectric layer interposed between said first planar radiator and said ground plane;

an elongated electrically conductive rod radiator extending through a central portion of said planar radiator and oriented normally to said planar radiator;

means for insulating said rod radiator from said planar radiator;

a loop radiator encircling said planar radiator and being electrically insulated from said planar radiator;

a second planar electrically conductive radiator disposed parallel to said first planar radiator and being located on a side of said first planar radiator opposite said ground plane;

a second dielectric layer interposed between said second planar radiator and said first planar radiator;

a first transmission line extending through said ground plane and said first dielectric layer to couple with said first planar radiator for coupling a first electromagnetic signal from said first planar radiator upon reception of electromagnetic radiation by said antenna;

a second transmission line extending through said ground plane and said first dielectric layer and said first planar radiator and said second dielectric layer to couple with said second planar radiator for coupling a second electromagnetic signal from said second planar radiator, said second planar radiator being smaller than said first planar radiator, and said second electromagnetic signal having a smaller wavelength than said first electromagnetic signal;

wherein a diameter of said first planar radiator and of said loop radiator is less than or equal approximately to one-half of a wavelength of radiation to be received respectively by said first planar radiator and said loop radiator; and said rod radiator has an electrical length greater than a cross-sectional dimension of said loop radiator for reception of radiation having a longer wavelength than radiation for said first planar radiator and for said loop radiator.

2. An antenna according to claim 1 wherein said loop radiator is disposed in a plane parallel to said ground plane, and said first dielectric layer extends between said loop radiator and said ground plane.

3. An antenna according to claim 2 wherein said loop radiator has a configuration which is square, said loop radiator having a first terminal and a second terminal adjacent to said first terminal, said loop radiator extending from said first terminal around said first planar radiator to said second terminal.

4. An antenna according to claim 1 wherein said insulating means comprises a dielectric cylinder disposed about said rod radiator.

5. An antenna according to claim 4 wherein said ground plane has an aperture therein for receiving said dielectric cylinder for supporting said rod radiator upon said plate, said aperture allowing passage of said rod radiator through said plate for coupling signals received by said rod radiator.

6. An antenna according to claim 1 wherein said first planar radiator is configured for reception of circularly polarized radiation, said antenna including a third transmission line, said first and said third transmission lines being coupled to spaced-apart positions of said first planar radiator for coupling orthogonal components of an electromagnetic signal from said first planar radiator.

7. An antenna according to claim 6 wherein said first planar radiator has a configuration of a rectangular patch.

8. An antenna according to claim 6 wherein said first planar radiator is a patch radiator, said second planar radiator being a patch radiator encircling said rod radiator.

9. An antenna according to claim 6 wherein said loop radiator is disposed in a plane parallel to said plate, and said first dielectric layer extends between said loop radiator and said plate.

10. An antenna according to claim 9 wherein said insulating means comprises a dielectric cylinder disposed about said rod radiator; and said ground plane has an aperture therein for receiving said dielectric cylinder for supporting said rod radiator upon said plate, said aperture allowing passage of said rod radiator through said plate for coupling signals received by said rod radiator.

11. An antenna according to claim 10 further comprising a protective cover layer of electrically insulating material disposed upon said first and said second planar radiators and said loop radiator.

12. An antenna according to claim 11 further comprising means for telescoping said rod radiator.

13. An antenna according to claim 1 further comprising a third planar radiator smaller than said second planar radiator, and a third dielectric layer;

wherein said third planar radiator is disposed parallel to said second planar radiator and on a side thereof opposite said ground plane, and said third dielectric layer is disposed between said second planar radiator and said third planar radiator; and said antenna further comprises a third transmission line passing through said ground plane and said first dielectric layer and said first planar radiator and said second dielectric layer and said second planar radiator and said third dielectric layer to couple with said third planar radiator for coupling a third electromagnetic signal from said third planar radiator upon reception of electromagnetic radiation by said antenna, said third electromagnetic signal having a wavelength smaller than the wavelength of said second electromagnetic signal.

14. An antenna according to claim 2 wherein said loop radiator has a configuration which is round, said loop radiator having a first terminal and a second terminal adjacent to said first terminal, said loop radiator extending from said first terminal around said first planar radiator to said second terminal.

15. An antenna according to claim 6 wherein said first planar radiator has a configuration of a spiral patch.

16. An antenna according to claim 6 wherein said first planar radiator has a configuration of a crossed dipole patch.

17. A multiple band antenna comprising:

an electrically conductive plate serving as a ground plane;

a first planar electrically conductive radiator disposed parallel to said ground plane, and a first dielectric layer interposed between said first planar radiator and said ground plane;

an elongated electrically conductive rod radiator extending through a central portion of said planar radiator and oriented normally to said planar radiator;

means for insulating said rod radiator from said planar radiator;

a loop radiator encircling said planar radiator and being electrically insulated from said planar radiator;

a second planar electrically conductive radiator disposed parallel to said first planar radiator and being located on a side of said first planar radiator opposite said ground plane;

a second dielectric layer interposed between said second planar radiator and said first planar radiator, said second planar radiator being smaller than said first planar radiator, and said second electromagnetic signal having a smaller wavelength than said first electromagnetic signal;

wherein a diameter of said first planar radiator and of said loop radiator is less than or equal approximately to one-half of a wavelength of radiation to be received respectively by said first planar radiator and said loop radiator; and said rod radiator has an electrical length greater than a cross-sectional dimension of said loop radiator for reception of radiation having a longer wavelength than radiation for said first planar radiator and for said loop radiator.

18. A multiple band antenna comprising:

an electrically conductive plate serving as a ground plane;

a first planar electrically conductive radiator disposed parallel to said ground plane;

an elongated electrically conductive rod radiator extending through a central portion of said planar radiator and oriented normally to said planar radiator;

means for insulating said rod radiator from said planar radiator;

a loop radiator encircling said planar radiator and being electrically insulated from said planar radiator;

a second planar electrically conductive radiator disposed parallel to said first planar radiator and being located on a side of said first planar radiator opposite said ground plane, said second planar radiator being spaced apart from said first planar radiator, said second planar radiator being smaller than said first planar radiator, and said second electromagnetic signal having a smaller wavelength than said first electromagnetic signal;

wherein a diameter of said first planar radiator and of said loop radiator is less than or equal approximately to one-half of a wavelength of radiation to be received respectively by said first planar radiator and said loop radiator; and said rod radiator has an electrical length greater than a cross-sectional dimension of said loop radiator for reception of radiation having a longer wavelength than radiation for said first planar radiator and for said loop radiator.

* * * * *